US006837029B2

(12) United States Patent
Morden et al.

(10) Patent No.: US 6,837,029 B2
(45) Date of Patent: Jan. 4, 2005

(54) METHOD AND APPARATUS FOR CLOSING OPEN END OF CARTON BLANK

(76) Inventors: George A. Morden, 468 Sierra Trail, Coralville, IA (US) 52241; Cletus E. Kreher, 425 W. 34th Ct., Marion, IA (US) 52302

( * ) Notice: Subject to any disclaimer, the term of this patent is extended or adjusted under 35 U.S.C. 154(b) by 0 days.

(21) Appl. No.: 10/686,761

(22) Filed: Oct. 16, 2003

(65) Prior Publication Data

US 2004/0079054 A1 Apr. 29, 2004

Related U.S. Application Data

(62) Division of application No. 09/977,436, filed on Oct. 15, 2001, now Pat. No. 6,669,614.

(51) Int. Cl.[7] ..... B65B 7/20

(52) U.S. Cl. ..... 53/491; 53/477; 53/376.3; 53/376.8; 493/162; 493/164; 493/166; 74/99 R; 74/107

(58) Field of Search ..... 53/477, 376.3, 53/376.6, 376.8; 493/102, 162, 164, 166, 267; 74/99 R, 101, 102, 103, 104, 107

(56) References Cited

U.S. PATENT DOCUMENTS

| | | | | |
|---|---|---|---|---|
| 3,018,702 A | | 1/1962 | Bauder | |
| 3,035,938 A | | 5/1962 | Schwinger | |
| 3,207,049 A | | 9/1965 | Monroe et al. | |
| 3,619,979 A | * | 11/1971 | Morden et al. | 53/565 |
| 3,875,810 A | | 4/1975 | Paramonoff | |
| 3,943,834 A | * | 3/1976 | Vetten | 493/164 |
| 3,999,469 A | * | 12/1976 | Nilsson | 493/164 |
| 4,106,355 A | * | 8/1978 | Cox et al. | 74/99 A |
| 4,292,102 A | * | 9/1981 | Bidegain | 156/213 |
| 4,509,312 A | * | 4/1985 | Nakajima | 53/373.9 |
| 4,776,830 A | | 10/1988 | Fujikawa et al. | |
| 5,085,029 A | | 2/1992 | Esper | |
| 5,120,292 A | | 6/1992 | Ueda et al. | |
| 6,073,503 A | | 6/2000 | Matsuno et al. | |
| 6,094,892 A | | 8/2000 | Lees | |

FOREIGN PATENT DOCUMENTS

| | | |
|---|---|---|
| EP | 0 863 332 A2 | 9/1988 |
| EP | 0 731 026 B1 | 1/2000 |
| EP | 0 999 135 A1 | 10/2000 |

* cited by examiner

*Primary Examiner*—Scott A. Smith
*Assistant Examiner*—Thanh Truong

(57) ABSTRACT

A carton closure method wherein heated end side walls of the open end of a carton are initially infolded to partially close the open end of the carton and thereafter subjected to capture between a backup pad and a pressure pad by a linearly reciprocative cam to which pressure is applied by a cam follower driven in a direction substantially perpendicular to the direction of linear movement of the cam relative to the backup pad, whereby the cam is moved between positions wherein there is applied pressure against the partially infolded portions of the end side walls of a carton blank to effect a sealing pressure against such infolded portions and a position wherein no material pressure is applied to the partially infolded end side walls of the carton blank, the cam movement being facilitated by a multi-faceted geometry of the camming face of the cam.

5 Claims, 5 Drawing Sheets

METHOD AND APPARATUS FOR CLOSING OPEN END OF CARTON BLANK

RELATED APPLICATIONS

This application is a divisional application of application Ser. No. 09/977,436, filed Oct. 15, 2001, entitled: Method And Apparatus For Closing End Of Carton Blank, now U.S. Pat. No. 6,669,614.

FIELD OF INVENTION

The present invention relates to apparatus and methods for the closing (sealing) of an open end of an "opened" blank for a carton such as are in common use for the packaging of juices, milk, etc., and particularly to the closure of the bottom end of the carton blank prior to filling of the carton with product.

BACKGROUND OF INVENTION

Packaging machines of the form-fill-seal type generally involve the formation of an open-ended carton, closing of the bottom end of the carton, filling the carton with a product, and thereafter closing the top end of the carton.

The economics of form-fill-seal packaging machines is based on the throughput of cartons through the packaging machine per unit of time. Techniques for enhancing the throughput of a given packaging machine include the use of dual production lines arranged in side-by-side relationship and employing certain common components of the packaging machine, filling techniques which minimize the loss of product from the carton in the course of the carton filling operation, and others. For any given machine, if the enhancement techniques have been essentially maximized, it may become necessary to look toward minimization of the energy employed in performing one or more, or even the overall, operation of the machine. Any conservation or reduction in the energy employed in the operation of the packaging machine clearly contributes to the economic value of the machine.

In a form-fill-seal packaging machine, a carton blank commonly includes a heat-sealable layer or coating on the outer and inner surfaces of the carton blank. Closure of the bottom of the carton commonly takes the form of prefolding portions of the end side walls of the open bottom end of the carton blank inwardly toward the centerline of the blank, along prescored fold lines. This infolding operation results in a plurality of the infolded portions of the carton overlying one another, at times there being three or more layers of overlying portions of the carton end side walls. To effect closure of the bottom of the blank, these end side wall portions are heated to soften the heat-sealable layer or coating, initially infolded relatively loosely and without interbonding, and thereafter pressed, employing high pressure, into intimate overlying relationship, and cooled to the extent that the overlying end side wall portions are securely bonded to one another to close (seal) the bottom of the carton.

SUMMARY OF INVENTION

In accordance with one aspect of the present invention, enhancement of the overall energy consumption is effected through the use of a unique closure system for the bottom end of an open-ended carton blank. The closure system of the present invention includes a pressure pad of conventional design which is urged against the external surfaces of a plurality of loosely associated overlying prefolded end side wall portions of the bottom end of a carton blank which is disposed on a mandrel which includes a backup pad disposed within the carton and contiguous to the internal surfaces of the prefolded end side wall portions to thereby capture the prefolded end side wall portions between the pressure pad and the backup pad. The force for urging the pressure pad initially against the loosely associated overlying prefolded end side wall portions and thereafter providing a sealing-pressure against the infolded end side wall portions and maintain this sealing pressure for a time sufficient to permit solidification of the softened heat-sealable component of the carton blank, in accordance with the present invention, is generated by means of a piston/cylinder operating through a pivoted arm whose distal end carries a cam follower that is moved against a linearly reciprocative cam which is operatively associated with the pressure pad. Of importance in the present invention is the contour of the camming face of the cam. In this regard, the contour of the cam is chosen to provide for maximum distance of movement of the cam, at a relatively low pressure applied by the piston/cylinder, to initially urge the loosely infolded portions of the carton bottom into their desired permanent positions relative to one another, followed by minimum distance of movement of the cam at a relatively high pressure to urge the contiguous ones of the overlying infolded end side wall portions intimately against one another, and hold the same under high pressure as the heat-sealing layer or coating thereon solidifies and bonds the overlying end side wall portions together to define a closed bottom for the carton.

In accordance with one embodiment of the present invention, the contour of the camming face of the cam, is provided with a first convex curvature of a first radius of curvature and relatively short length, which transitions relatively sharply into a second and concave curvature of a second radius of curvature and relatively long length. When viewed in a side elevational view (see FIG. 7), the transition between these curves of the camming surface are both tangent to an imaginary line drawn through the transition of the two curves and being oriented six degrees from the vertical. Moreover, both the curves are tangent to one another at their transition.

For example, employing the present invention at an air pressure setting of 85 psi, for example, one can develop a sealing pad force at the pressure pad which is at least 25% greater than the sealing pad force developed by the same air pressure setting and employing a prior art "in-line" piston/cylinder subassembly having a bore of about 2.5 times larger. This ability to employ a smaller bore in the cylinder thus provides an enhanced sealing pressure while employing about ⅓ the volume of pressurized air.

DETAILED DESCRIPTION OF THE INVENTION

Figure 1:
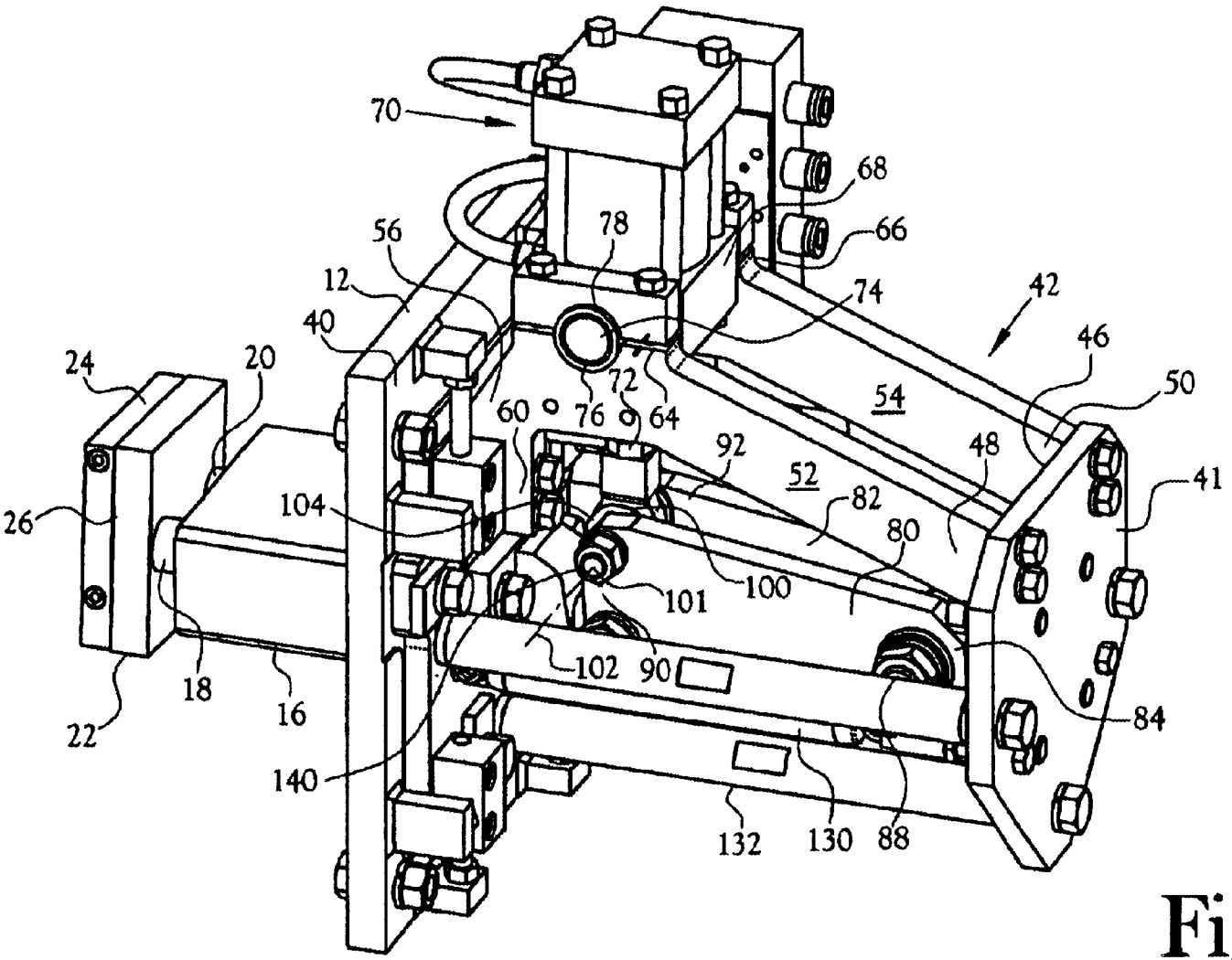
FIG. 1 is a perspective view of one embodiment of an apparatus for closing the open end of a cylindrical (rectangular cross-section) carton blank and embodying various of the features of the present invention
Figure 2:
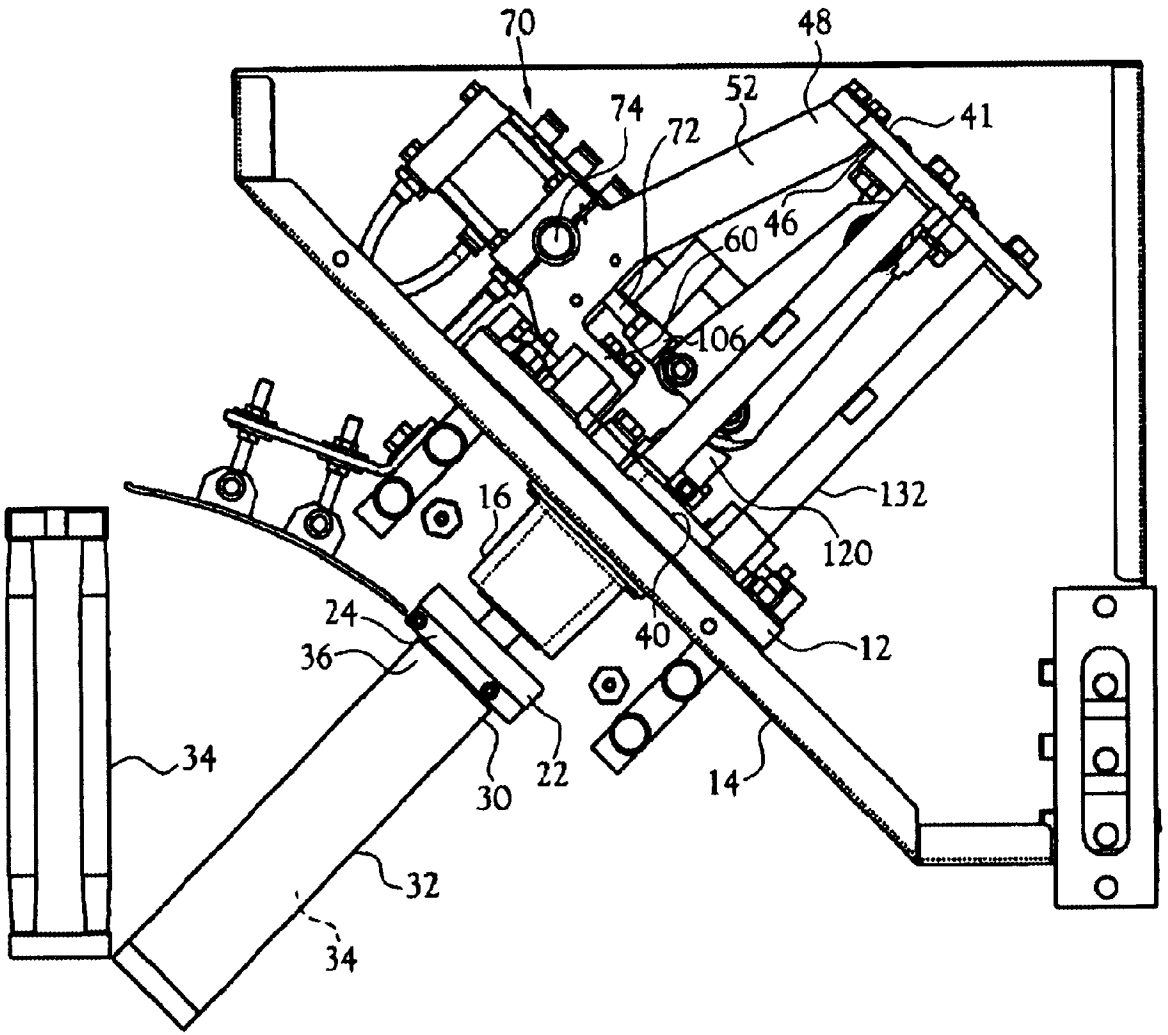
FIG. 2 is a side plan view of one embodiment of apparatus depicted in FIG. 1 for closing the open end of a carton blank and depicting the environment of the application of the present invention.
Figure 3:
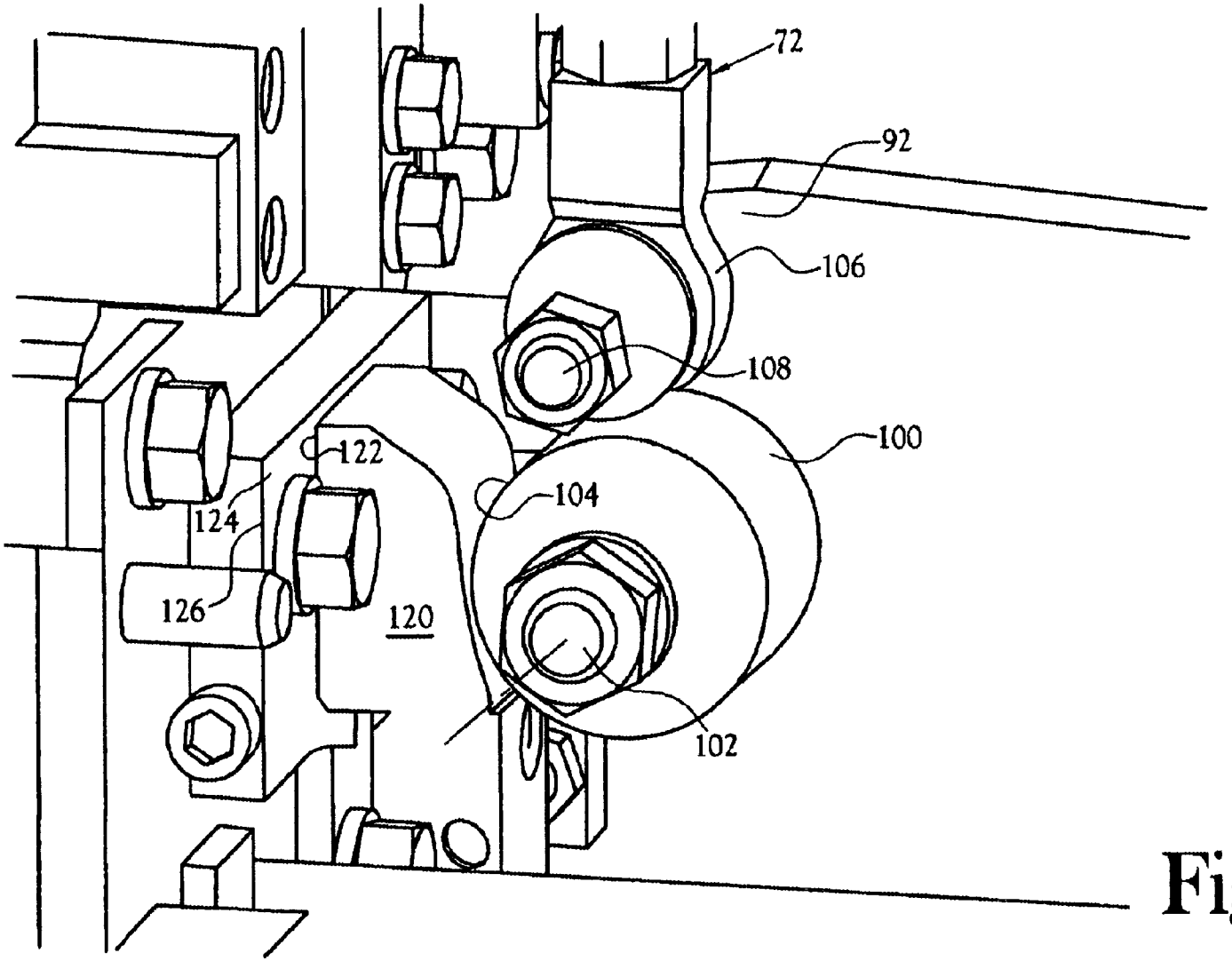
FIG. 3 is a perspective view of a portion of the apparatus depicted in FIG. 1 and depicting the cam/cam follower components of the apparatus.
Figure 4:
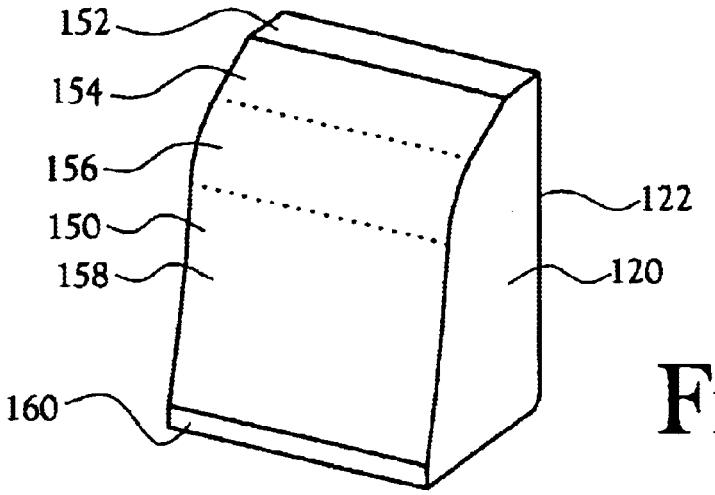
FIG. 4 is a representation of one embodiment of a cam suitable for use in the present invention.
Figure 5:
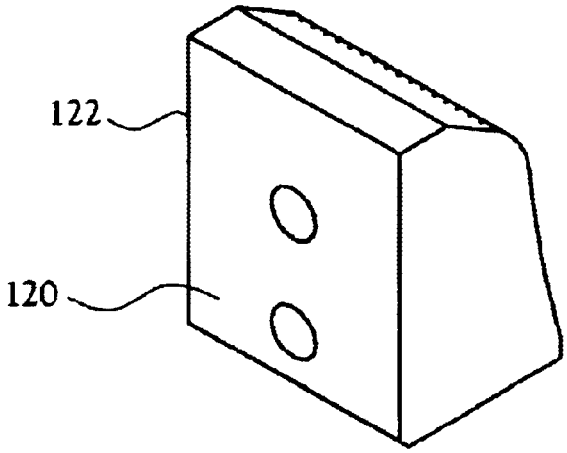
FIG. 5 is a further representation of the cam depicted in FIG. 4.
Figure 6:
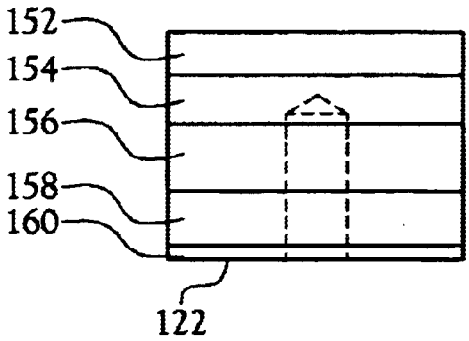
FIG. 6 is a top view of the cam depicted in FIG. 4.

Referring initially to FIGS. 1 and 2, the depicted embodiment of the apparatus of the present invention comprises a base plate 12 which serves to mount the apparatus on the structural framework 14 of a packaging machine (not shown) and includes an outboard block 16 which is bored therethrough to define two elongated openings within which there are reciprocatively received first and second pressure rods 18 and 20. A pressure pad receiver 22 is attached to the outboard ends of the rods and, in turn, a pressure pad 24 is removably secured to the outboard surface 26 of the pressure pad receiver in position to engage to partially closed end 30 of a carton blank 32 mounted on a mandrel 34 of a blank forming carousel (not shown) as is well known in the art. Internally of the partially closed end 38 of the blank on the mandrel, there is disposed a solid rigid rectangular backup pad 36, also as is well known in the art.

Further, the base plate 12 serves to have mounted thereon or therein various of the operative elements of the apparatus. Specifically, on a first (inboard) face 40 of the base plate, there is mounted a pressure-generating and transfer subassembly 42 which includes a rear mounting plate 41 having an inboard face 46 to which there is anchored the first ends 48 and 50 of first and second substantially identical rigid arms 52, 54, respectively. These arms extend in parallel and spaced apart relationship with one another upwardly and toward the base plate 12. Each of the second ends 56 of these arms terminates in the form of a respective downwardly extending section 60 which is anchored to the inboard face 40 of the base plate 12. Intermediate the opposite ends of each of the arms, a portion 64 of each of the top surface of the arms is adapted to receive thereon the structural framework 68 of a piston/cylinder subassembly 70, the piston rod 72 thereof depending downwardly between the spaced apart arms 52, 54.

In the depicted embodiment the mounting of the structural framework of the piston/cylinder subassembly to the top sides of the arms 52, 54 is in the nature of a cylindrical shaft 74 which is mounted within facing semicircular grooves 76, 78 provided within the top surface of each of the arms and within the bottom surface of the structural framework of the piston/cylinder subassembly. Thus, the piston/cylinder is readily removable from the subassembly for service or replacement.

At locations generally internally of the pressure-generating and transfer subassembly 42, there are provided first and second side arms 80 and 82 which have their first ends 84, 86 pivotally anchored to the inboard face 46 of the rear mounting 41 as by a pivot pin 88 which is mounted on the inboard face 46 of the rear mounting plate 41. These side arms extend parallel and in spaced apart relationship to one another toward the base plate 12. The distal ends 90, 92 of these side arms are coterminal at a location spaced apart from the inboard face of the base plate and receive therebetween at locations adjacent their distal ends, a roller cam follower 100 which is rotatably mounted on a shaft 101 which extends between the spaced apart distal ends of the side arms. Notably, the rotation axis 102 of the roller cam follower 100 is disposed perpendicular to the length dimensions of the side arms and the distance between the location of such axis 102 with respect to the distal ends of the side arms is chosen to ensure that the outer circumference 104 of the roller cam follower 100 projects beyond the distal ends of the side arms.

Further, adjacent the distal ends of the side arms and interposed between the spaced apart side arms, there is pivotably mounted the distal end 106 of the piston rod 72 of the piston/cylinder subassembly, such mounting being in the form of a pivot pin 108 whose opposite ends are secured in respective ones of the side arms. At this juncture, it is to be noted that reciprocative movement of the piston rod 72 produces like reciprocative movement of the distal ends of the side arms and also simultaneous reciprocative movement of the roller cam follower 100 disposed between the side arms.

In the present apparatus, there is further provided a cam 120 at a location intermediate the inboard face of the base plate 12 and the distal ends of the side arms (and the roller cam follower). More specifically, a rear planar face 122 of the cam 120 is disposed in facing engagement with the inboard face 124 of a rigid block 126 and anchored in such relationship by bolts 128 or other suitable fasteners. This rigid block 126, in turn, is fixedly mounted to the inboard ends (not visible in the figures) of the pressure rods 18, 20 which are reciprocatively mounted in the outboard block 16, thereby mounting the cam 120 reciprocatively in a direction perpendicular to the inboard face 40 of the base plate 12 and providing a rigid mechanism for the transmission of pressure applied to the cam to the pressure pad 24 which is mounted on the outboard ends of the pressure rods 18, 20.

Further, the piston/cylinder subassembly 70 is provided with one or more spring members 130 which extend between the inboard face 46 of the rear mounting plate 41 and the bottom margin of the inboard face 40 of the rigid block 126 and adapted to resiliently urge the cam in a direction of engagement of the cam 120 with the circumferential outer surface 104 of the roller cam follower 100.

Of importance in the present invention is the contour of the camming face 140 of the cam 120. It will be recalled that the closure of the end, bottom end, for example, of an open end of a carton blank involves the steps of heating of portions of the end side walls of the carton blank to at least their heat-sealing temperature, at least partially infolding these end side wall portions toward each other to cause them to define a closed bottom end of the carton, and thereafter applying pressure to these partially infolded end side wall portions, some of which overlies portions of themselves or other end side wall portions. At this stage of the closure operation, the infolded end side wall portions are not sealed to another, nor do they define a flat bottom for the carton. Rather, the infolded end side wall portions, at this stage of formation, tend to project outwardly from the desired plane of the bottom of the carton. Thus, it is required in completing the formation of the desired planar bottom of the carton that these infolded end side wall portions be initially pressed together relatively gently, but rapidly, such that each of the infolded end side wall portions is caused to assume its intended position as a part of the defined bottom of the carton. Following, and only after this relatively gentle, but rapid, orientation of the infolded end side wall portions, the oriented infolded end side wall portions are forced into intimate relationship to one another, particularly those overlying areas of the infolded end side wall portions, and so held in this intimate relationship for a time sufficient for the heated infolded end side wall portions to bond to one another, through the means of solidification of the heat sealing material which is associated with these end side wall portions. After the sealing has been effected, the pressure applied to the end side wall portions is released so that the carton may be moved to a further station of the form-fill-seal packaging machine. As also noted hereinabove, desirably, there is a minimum of pressurized fluid employed in the pressure-applying function associated with the closure of the end of the carton blank.

In accordance with one aspect of the present invention, the present inventors have discovered that through the combination of a pivoted cam follower 100 acting on a horizontally reciprocative cam 120, one can develop successive stages of pressure application to the infolded end side wall portions of the carton blank, each stage being characterized by a chosen time span and a chosen degree of movement of the cam, hence a chosen degree of pressure and its duration of application to the infolded end side wall portions of the carton blank by the pressure pad 24. Importantly, through this combination, it has also been found that minimum energy applied via a piston rod 72 and a pivoted roller cam follower 100 can be caused to effect maximization of the desired effect upon the infolded end side wall portions.

Figure 7:
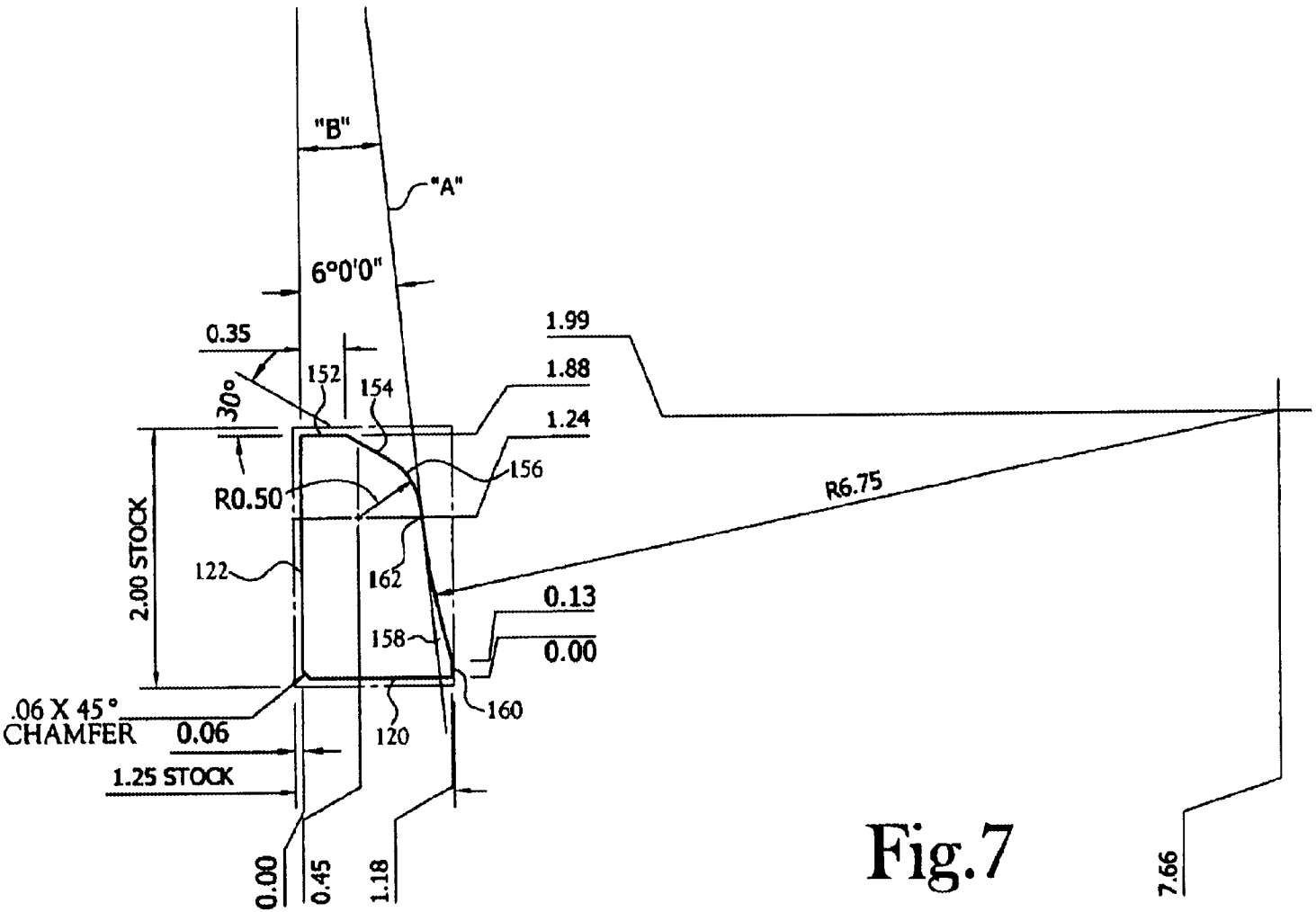
FIG. 7 is a side elevational view of the cam depicted in FIG. 4 with dimensional parameters defined thereon.

In a specific example, employing the indirect action of a pivoted roller cam follower 100 acting upon a cam 120 which is reciprocatively mounted for linear movement in a direction perpendicular to the path of movement of the cam follower, (when viewed as in FIG. 7) at an air pressure setting of 85 psi, for example, one can develop a sealing force at the pressure pad which is at least 25% greater than the sealing force developed by the same air pressure setting and employing a cylinder having a bore about 2.5 times larger. This ability to employ a smaller bore in the cylinder thus provides an enhanced sealing pressure while employing about ⅓ the volume of pressurized air.

Referring to FIGS. 4–7, in one embodiment, the cam 120 of the present invention includes a planar rear face 122 and a contoured face which defines its camming surface 150. This surface 150, in the embodiment depicted in FIGS. 4 and 7, comprises a horizontal first surface portion 152 which transitions into a straight second portion 154 which angles downwardly at an angle of about 45° from the horizontal, which transitions into a convex radiussed third surface portion 156 (radius=0.500 inch), which transitions into a fourth concave radiussed surface portion 158 (radius=6.750 inch), which transitions into a vertical fifth surface 160. As noted in FIG. 7, the curved surfaces of the third surface 156 and the fourth surface 158, at their transition 162 are both tangent to the line "A" which intersects the extended plane of the rear surface 122 of the cam at an angle "B" of 6°, and to each other. Further, in this embodiment, the cam is 1.88 inches high and the transition between the second and third radiussed surfaces occurs at a height of 1.240 inches from the bottom surface of the cam, and the transition between the fourth and fifth surfaces occurs at a height of 0.18 inch. Thus, the horizontal (linear) travel of the cam, hence the majority of the linear travel of the pressure pad into engagement with the partially infolded end side wall portions of the carton blank during a pressing cycle of the apparatus, occurs during approximately the first 36% of the total vertically downward movement of the roller cam follower during a single pressing operation. It is during this first 36% of the pressing cycle that the least amount of pressure, but a maximum of linear movement of the cam (and pressure pad), is required to orient the already loosely partially infolded end side wall portions of the carton blank. By reason of the relatively sharp radius of the path of this first 36% of the cam follower travel, the rate of linear travel of the cam is greatest when the roller cam follower is moving along the relatively sharply inclined (with respect to the horizontal) second and third cam surfaces 154, 156. Thus, there is achieved in this initial portion of a pressing cycle, a maximum of linear travel of the cam employing a minimum of energy required of the piston/cylinder subassembly.

Following the initial orientation of the infolded end side wall portions of the carton blank, it remains only that there be increased pressure applied to the infolded end side wall portions to effect the necessary intimacy of the engagement of the overlying portions of the infolded end side wall portions, and maintenance of this intimacy for a time sufficient for the heated heat-sealable matter of the carton blank to solidify and effect permanent bonding of the newly defined bottom of the carton blank. The present inventors have found that by passing the roller cam follower through the transition 162 between the third and fourth cam surfaces 156, 158, and by reason of the relatively large radius of curvature of the third convex cam surface 158, and the changeover from a convex curved cam surface to a concave cam surface, the roller cam follower is caused to move through about 64% of its overall travel during a pressing cycle over a relatively long time span, but with only very little increase in pressure being applied to the cam to effect linear movement of the cam during this relatively longer portion of time of the pressing cycle. That is, during about the first 36% of the pressing cycle, substantially the maximum pressure to be applied to the infolded end side wall portions of the carton blank is achieved. This substantially maximum pressure is developed during the action of orienting the initially infolded end side walls of the carton blank where the least amount of energy is to be exerted against the infolded end side walls is needed. Thereafter, during about the final 64% of the pressing cycle, the piston/cylinder is called upon to exert only a relatively small increase in pressure while holding the already established pressure against the cam. These actions have been found to conserve substantial energy in the form of minimization of the quantity of pressurized-fluid employed to activate the piston/cylinder subassembly. Specially, as-noted hereinabove, for a given air pressure setting (e.g., 85 psi), these savings are manifested in the form of a cylinder bore reduction of about 60%, an decrease in required cylinder force of about 80%, and a seal pad force increase of about 25%, as compared to the prior practice of mounting the pressure pad on the end of an "in-line" piston rod of a piston/cylinder subassembly. Moreover, in the present invention, the volume of pressurized air employed during a pressing cycle is about 30% of the pressurized air employed in a prior art "in-line" piston/cylinder subassembly, meaning that the present invention requires about 70% less energy in the form of pressurized air, while providing a pressure pad force about 25% greater than the prior art "in-line" air pressurized piston/cylinder devices.

In accordance with one embodiment, the method of the present invention comprises the steps of reciprocatively mounting a pressure pad to a linearly reciprocative cam, defining a plurality of camming surfaces on a face of the cam, including at least first, second and third camming surfaces which include successively increasing orientation with respect to the vertical, with the third camming surface defining a convex curvature of a first radius, transitioning the third camming surface into a fourth camming surface having a a concave curvature of a second radius, the second radius being materially larger than the first radius, mounting a cam follower on the distal end of a pivotally mounted cam support, the cam follower being disposed adjacent and in operative engagement with the plurality of camming surfaces, applying a force to the distal end of the cam support to thereby move the cam follower along successive ones of said first, second, third and fourth (commonly) camming surfaces and, in turn, exert a force against the cam to move the cam and the pressure pad mounted thereon, linearly in a direction away from the cam follower at an initial rate of linear travel of the cam followed by continued linear movement of the cam in a direction away from the cam follower at a rate of linear travel which is multiple times slower than the initial rate of travel of the cam, and wherein the duration of the time of the initial rate of linear travel of the cam is multiple times less than the time of travel of the cam during its continued linear movement during a pressing cycle.

In one embodiment of the method of the present invention, the step of exerting a force against the cam comprises a piston/cylinder subassembly, the piston member of which is activated by the introduction of pressurized fluid into the cylinder. In a more specific embodiment, the method provides a force applied to the pressure pad of about 3170 lbs employing a cylinder bore of 2.5 inches and an air pressure setting of 85 psi, employing a volume of 9.4 $in^3$ of pressurized air per pressing cycle.

Whereas the present invention has been described in specific terms for purposes of clarity and understanding, it will be recognized by one skilled in the art that various modifications and/or alternatives may be employed without departing from the substance of the invention. It is intended, therefore, that the present invention be limited only as set forth in the claims appended hereto.

What is claimed:

1. A method for the closure of an open end of a carton blank including a heat-sealable component, wherein the end side walls adjacent the open end of the carton are heated to at least their heat-sealing temperature and initially infolded to partially close the open end of the carton, comprising the steps of capturing the heated and initially infolded end side walls of the carton between a rigidly mounted backup pad disposed within the interior of the carton blank and a pressure pad disposed externally of the carton blank and mounted for reciprocative movement toward and away from said backup mandrel, disposing a linearly reciprocative cam in operative relationship to said pressure pad to apply pressure to said pad upon linear movement of said cam toward said pressure pad, providing on said cam a camming face disposed opposite said pressure pad, providing a cam follower disposed adjacent to and in operative relationship to said camming surface, applying a force against said cam follower in a direction substantially perpendicular to the direction of linear movement of said cam to thereby move said cam and said pressure pad toward said backup pad by a distance sufficient to press the infolded end side wall portions of the carton blank into intimate overlying relationship to one another, and maintaining said pressure applied to said infolded end side wall portions for a time sufficient to effect solidification and sealing of said infolded end side wall portions to one another and thereby close the end of the carton blank.

2. The method of claim 1 and including the step of operatively connecting said cam follower to the piston rod of a piston/cylinder subassembly whereby extension of said piston rod effects pivotal movement of said cam follower.

3. The method of claim 1 and including the step of providing a plurality of camming surfaces which collectively define said camming face of said cam.

4. The method of claim 3 wherein said plurality of camming surfaces includes a camming surface having a convex radiussed geometry extending over a portion of said camming face, and a further camming surface having a concave radiussed geometry extending over a further and contiguous portion of said camming face, said convex radiussed camming surface transitioning into said concave radiussed camming surface along an imaginary line drawn tangent to said transition between said camming surfaces and said radiussed camming surfaces are tangent to one another at said transition.

5. The method of claim 3 wherein said plurality of camming surfaces of said cam includes a straight first surface portion which transitions into a straight second portion which angles downwardly at an angle of about 45° from the horizontal, which transitions into a convex radiussed third surface portion, which transitions into a fourth concave radiussed surface portion, which transitions into a straight fifth surface.

* * * * *